US005899615A

United States Patent [19]

Sansone

[11] Patent Number: 5,899,615

[45] Date of Patent: May 4, 1999

[54] APPARATUS AND METHOD FOR TWO-SIDED PRINTING

[75] Inventor: Ronald P. Sansone, Weston, Conn.

[73] Assignee: Pitney Bowes Inc., Stamford, Conn.

[21] Appl. No.: 08/766,654

[22] Filed: Dec. 16, 1996

[51] Int. Cl.[6] ..... B41J 3/60

[52] U.S. Cl. ..... 400/188; 101/91; 347/103

[58] Field of Search ..... 400/82, 104, 105, 400/188; 101/91; 347/2, 4, 103

[56] References Cited

U.S. PATENT DOCUMENTS

| | | | |
|---|---|---|---|
| 2,660,111 | 11/1953 | Herrick et . | |
| 3,376,812 | 4/1968 | Sterling . | |
| 3,522,769 | 8/1970 | Priesmeyer | 101/3 |
| 3,536,007 | 10/1970 | Harvey | 101/327 |
| 3,688,695 | 9/1972 | James | 101/211 |
| 3,701,317 | 10/1972 | Miyameric | 101/170 |
| 3,724,369 | 4/1973 | Gery | 101/327 |
| 3,732,809 | 5/1973 | Sawada | 101/35 |
| 3,752,068 | 8/1973 | Trampoech | 101/93 |
| 3,869,986 | 3/1975 | Hubbard | 101/91 |
| 3,964,383 | 6/1976 | Delligatti | 101/44 |
| 4,052,938 | 10/1977 | Kirby | 101/291 |
| 4,116,126 | 9/1978 | Miner | 101/77 |
| 4,402,263 | 9/1983 | Honkawa | 101/350 |
| 4,403,547 | 9/1983 | Forberger | 101/170 |
| 4,448,872 | 5/1984 | Vandervalk | 430/126 |
| 4,508,034 | 4/1985 | Schuneman | 101/365 |
| 4,611,538 | 9/1986 | Simeth | 101/365 |
| 4,615,266 | 10/1986 | DeRoche et al. | 101/163 |
| 4,673,303 | 6/1987 | Sansone et al. | 101/91 |
| 4,838,162 | 6/1989 | Horton et al. | 101/296 |
| 5,471,233 | 11/1995 | Okamoto et al. | 347/103 |
| 5,558,449 | 9/1996 | Morgavi | 400/188 |
| 5,677,719 | 10/1997 | Granzow | 347/103 |
| 5,688,057 | 11/1997 | Wright et al. | 400/188 |
| 5,730,533 | 3/1998 | Noy et al. | 400/708 |
| 5,746,526 | 5/1998 | Hirose | 400/619 |

*Primary Examiner*—Ren Yan

*Attorney, Agent, or Firm*—Ronald Reichman; Robert H. Whisker; Melvin J. Scolnick

[57] ABSTRACT

An apparatus and method for two-sided printing on items such as mail pieces. A printing station includes an ink jet printhead which is spaced from a transfer roller. As the roller rotates the printhead forms a first image on the surface of the roller. A mail piece or other item to be printed is feed through the printing station to pass between the printhead and the roller with the timing control so that the mail piece makes tangential, rolling contact with the transfer roller just as the image is completed on the roller and the image is then transferred from the roller to one side of the mail piece as the mail piece continues through the printing station by an offset printing process. As the mail piece passes between the roller and the printhead the printhead is controlled to print a second image on the opposite side of the mail piece.

16 Claims, 3 Drawing Sheets

APPARATUS AND METHOD FOR TWO-SIDED PRINTING

BACKGROUND OF THE INVENTION

The subject invention relates to an apparatus and method for printing on both sides of a sheet or other item to be printed. More particularly, it relates to an apparatus and method wherein a single printhead can be used to print on both sides of an item such as a mail piece.

FIG. 1 shows a front view of a typical mail piece 10 of the kind prepared by high volume mailers such as banks, utilities, or department stores. Typically such a high volume user will print postal indicia 12 on mail piece 10 as evidence that the appropriate postage has been paid.

As is well known, postage meters are devices which can be charged with a representation of a dollar (or other currency) amount upon payment of that amount to a postal service and which can then print postal indicia such as indicia 12 as evidence of postage payment until the amount paid is expended. To provide security, indicia 12 includes date 16, postage amount 14, and meter serial number 20, as well as other information.

Other information on mail piece 10 includes a destination address printed in field 22, a return address printed in field 24, and frequently advertising graphics or slogans in fields 28. Typically, in return for postage discounts, high volume mailers will also print routing or sorting information on the front of mail piece 10 to assist the postal service in automatically processing the mail.

Historically postal indicia have been printed by rotary or letter press impact printers which had a limited capability to vary information such as amount 14 and date 16. Such meters relied on the arbitrary and fanciful nature of significant parts of the fixed information printed in each indicia and the mechanical complexity of a mechanism for combining variable information with that fixed information, for security of the indicia. In recent years however, it has become apparent that there are many advantages to using digital, bit-mapped printing technology to print postal indicia, along with other information, on a mail piece. One disadvantage to this approach however, has been that such indicia can easily be counterfeited by anyone having access to a personal computer and a suitable printer, such as an ink jet printer.

To overcome this problem, it has been proposed to incorporate index numbers in postal indicia, so that each indicia would be unique, encrypt at least part of the information in the indicia, and print this encrypted information on mail pieces in machine readable form together with the indicia. Decryption and comparison of the information with the corresponding indicia would then demonstrate that the indicia had been produced by someone having access to the appropriate encryption key; i.e. an authorized postage meter user.

While it is believed that such encryption techniques will provide adequate security inspection of FIG. 1 shows that there maybe substantial difficulty finding space for the encrypted information on the face of mail piece 10. Further, large amounts of encrypted information, typically in barcode form, would give mail piece 10 a cluttered and unattractive appearance.

Accordingly, it is an object of the subject invention to provide a printing mechanism, suitable for use in a postage meter, which has a capability for printing bit-mapped indicia on both sides of a mail piece or other item to be mailed.

BRIEF SUMMARY OF THE INVENTION

The above object is achieved and the disadvantages of the prior art are overcome in accordance with the subject invention by means of an apparatus and method for printing which includes a printing station, a guide station, a feeder for feeding the item to be printed through the guide, and a controller. The printing station includes a transfer roller and a printhead spaced from the transfer roller. The guide guides the item to be printed through the print station along a path such that the item makes tangential rolling contact with the transfer roller so that a first print image on the transfer roller is transferred to one side of the item and so that an opposite side of the item passes close to the printhead. The controller controls the printhead to form a reverse of the first image on the transfer roller before the item reaches the roller, and then controls the printhead to print a second image on the opposite side of the item.

In accordance with one aspect of the subject invention one of the images is a postal indicia.

In accordance with another aspect of the subject invention another of the images includes an encrypted representation of information in the indicia.

In accordance with still another aspect of the subject invention the second image is printed as the first image is transferred from the transfer roller.

In accordance with still yet another aspect of the subject invention the printhead is an ink jet printhead.

Those skilled in the art will readily appreciate that the above described invention achieves the stated object. Other objects and advantages of the subject invention will be apparent to those skilled in the art from consideration of the detailed description set forth below and the attached drawings.

DETAILED DESCRIPTION OF PREFERRED EMBODIMENT OF THE INVENTION

Figure 1:
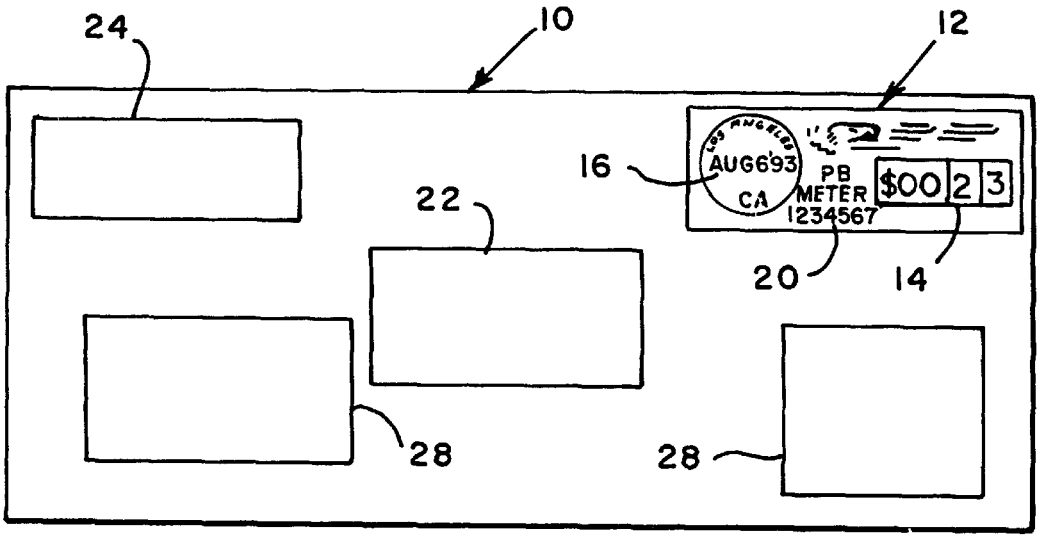
FIG. 1 (PRIOR ART)
FIG. 1 is a plan view of the front of a typical mail piece produced by a high volume mailer.
Figure 2:
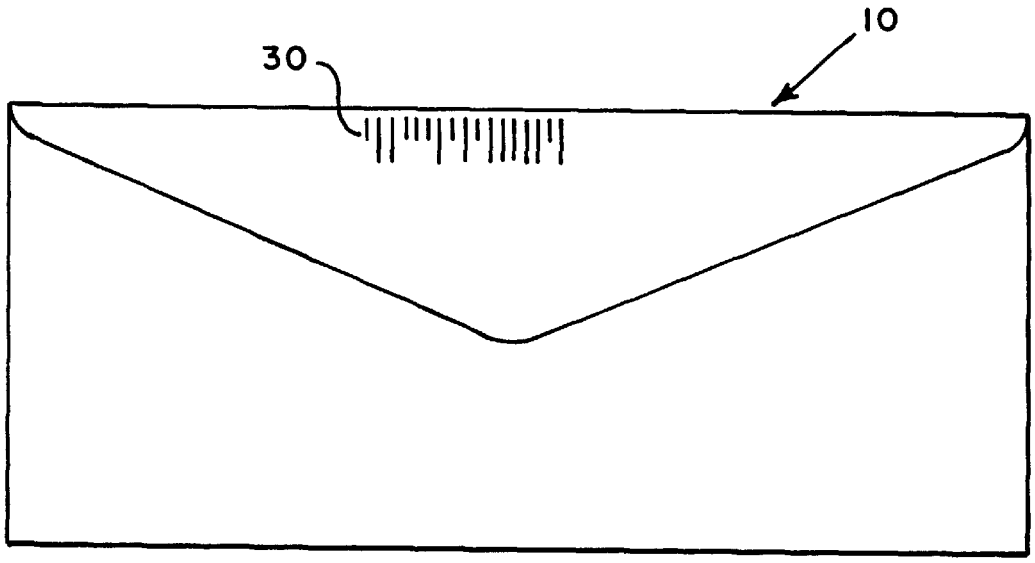
FIG. 2 is a plan view of the back of the mail piece of FIG. 1 which has been printed in accordance with the subject invention.

FIG. 2 shows the back of mail piece 10, described above. Barcode 30 is preferably a representation of encrypted information from indicia 12, which has been printed in accordance with the apparatus and method of the subject invention, as will be described further below. While barcode 30 is shows as a conventional bar/half bar code for clarity of illustration, where extensive amounts of information is encoded a two dimensional barcode such as PDF-417 barcode can be used. Further, printing of other types of information, such as routing or sorting information for use by a postal service, in other forms, such as alpha numeric characters, is also within the contemplation of the subject invention.

Figure 3:
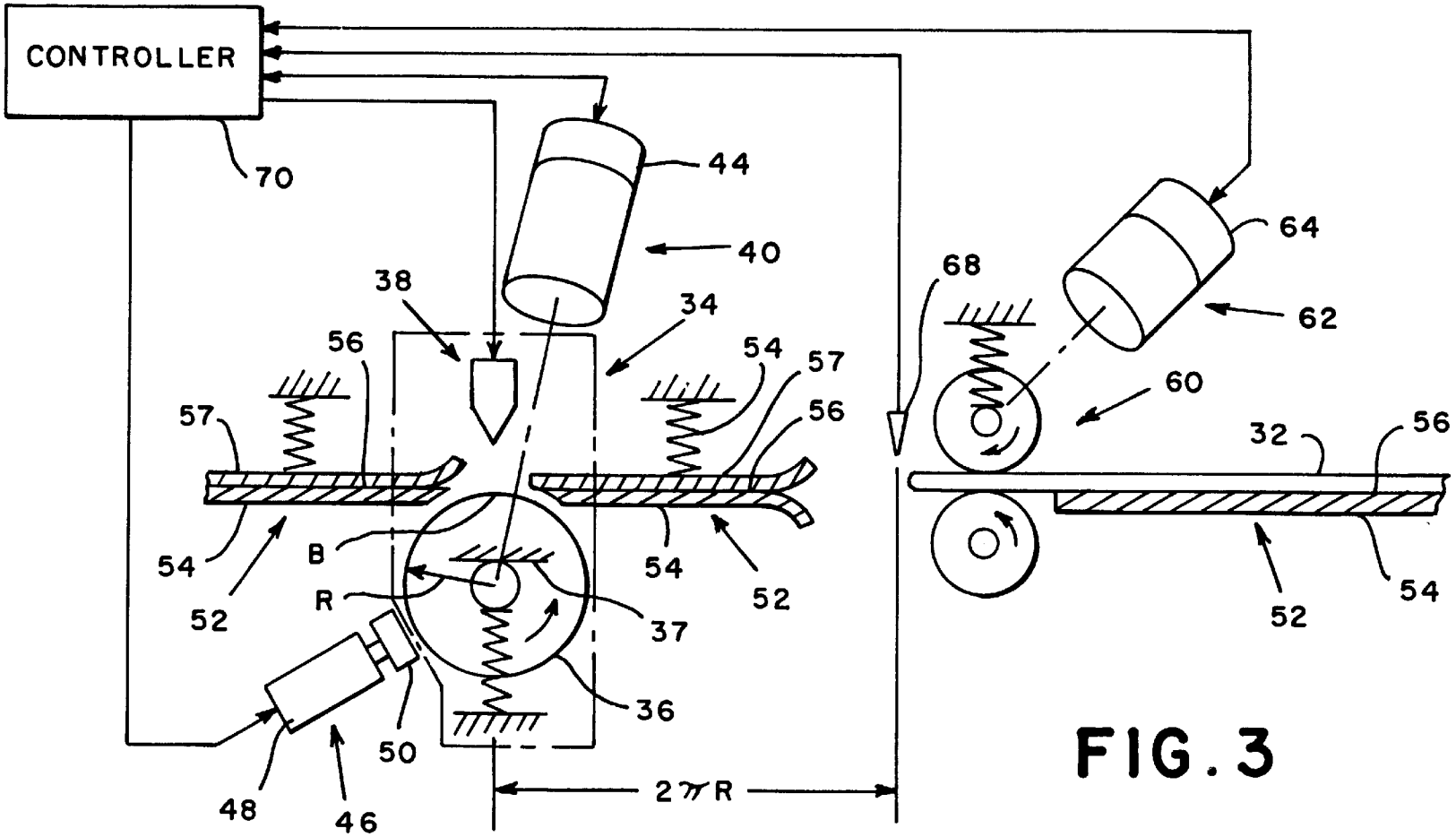
FIG. 3 is a schematic representation of an apparatus in accordance with the subject invention.

Turning to FIG. 3 a mail piece 32, or other item to be printed, is provided by any suitable mechanism (not shown). Printing station 34 includes a transfer roller which is preferably formed of silicon rubber or other suitable material, which has a radius R, and which is spring biased upwards against stop 37. Station 34 also includes a printhead which is preferably a piezoelectric ink jet printhead which is positioned proximate to, but spaced from transfer roller 36 for forming a reverse print image on roller 36 as will be described further below.

Transfer roller 36 is driven by motor assembly 40, which is preferably a stepping motor and includes encoder 44.

An articulated wiper assembly 46 is provided for removing residual ink from roller 36, as will be described further below. Assembly 46 includes solenoid 48 and pad or roller 50.

Mail piece 32 is supported by guides 52 which include lower guides 54, which define horizontal registration surface 56, and spring biased upper guides 57 for maintaining registration of mail piece 32 as it is printed. Stop 37 restrains roller 36 so that it is substantially tangent to surface 56 without touching guides 52, so as to make good contact with mail piece 32 to effectively transfer an image to the lower side of mail piece 32.

Feed roller assembly 60 feeds mail piece 32 through print station 34. Assembly 60 is driven by motor assembly 62, which is preferably a stepping motor and includes encoder 64.

Sensor 68 is provided to sense the leading edge of mail piece 32 when it is a distance 2 pi R from printhead 38 and the center line of transfer roller 36.

Controller 70 is responsive to sensor 68 and controls printhead 38, motor assemblies 40 and 62, and wiper assembly 46 in a conventional manner. Controller 70 is preferably a microprocessor based, programmable controller. Programming of such controllers to control an ink jet printhead to print selected images, control motor assemblies, and activate solenoids is well within the ability of those skilled in the art and the details of such programming need not be discussed further here for an understanding of the subject invention.

When sensor 68 detects the leading edge of mail piece 32 controller 70 responds to control printhead 30 to begin forming the reverse of a predetermined image, for example a postal indicia, on the circumference of roller 36 as it rotates. In a preferred embodiment of the subject invention controller 70 is responsive to information from encoders 44 and 64 to maintain motor assemblies 40 and 62 at predetermined rotational velocities such that the linear velocity of mail piece 32 is equal to the circumferential velocity of roller 36.

Solenoid 48 is deactivated and pad 50 is spaced from roller 36.

In a preferred embodiment of the subject invention mail piece 32 is provided to roller assembly 60 by any convenient mechanism such as an inserter system for inserting preprinted sheets into an envelope and sealing the envelope. (not shown) Feed roller assembly 60 continues to feed mail piece 32 along guides 52 to printing station 34. When sensor 68 detects the leading edge of mail piece 32 a signal is sent to controller 70 which then controls ink jet 38 to begin forming a first image along a line B opposite 38 and parallel to the axis of roller 36.

Since mail piece 32 moves with a linear velocity equal to the circumferential velocity of roller 36 the leading edge of mail piece 32 will be opposite printhead 38 just as the image on roller 36 is completed and line B returns to the point opposite 38. The presence of mail piece 38 opposite printhead 30 can be determined by any convenient method, such as incorporating a second sensor (not shown) or by monitoring the output of encoders 44 and/or 64 to measure the distance traveled by mail piece 32.

Figure 4:
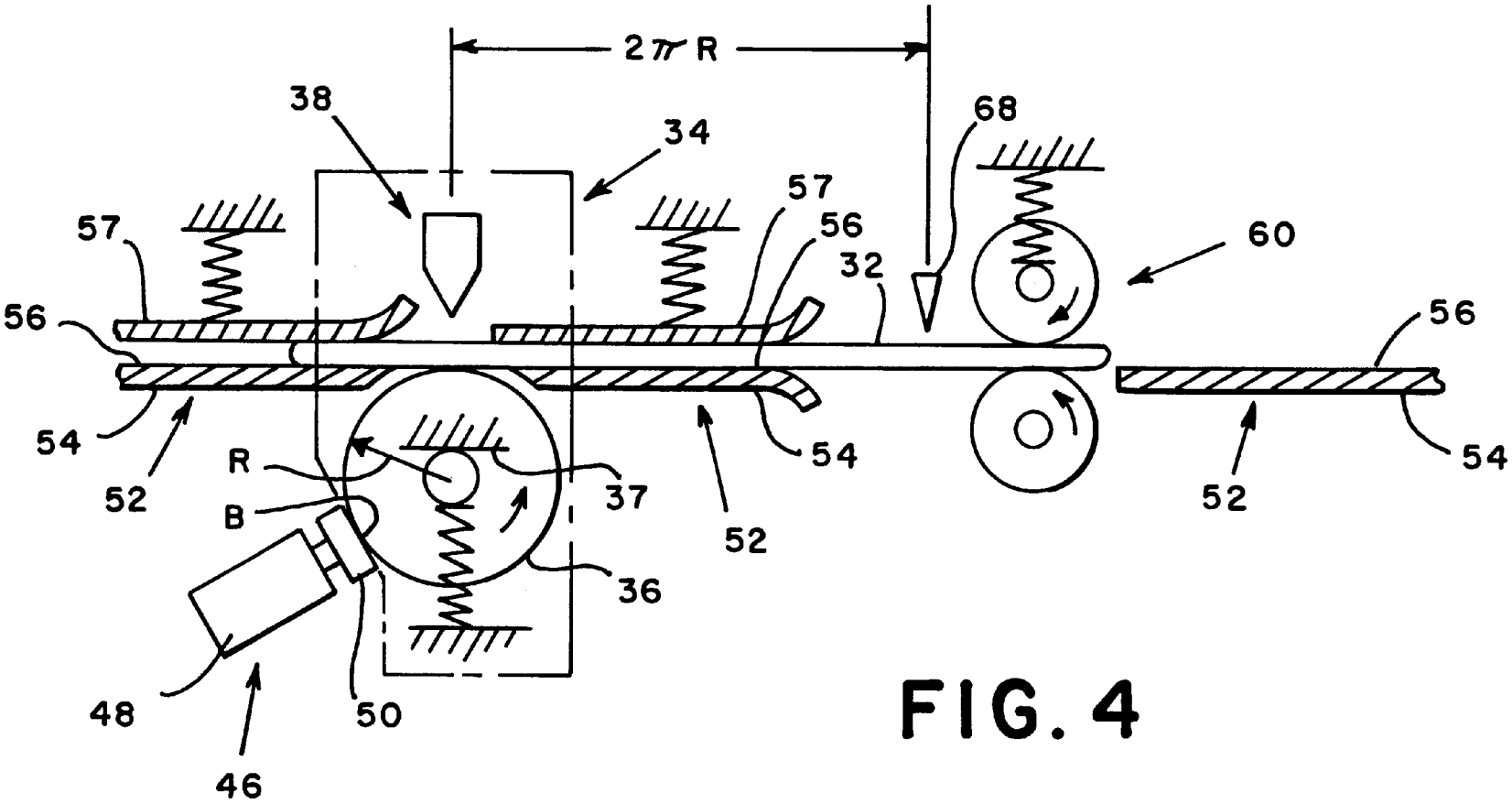
FIG. 4 is a schematic representation of a portion of the apparatus of FIG. 3 as a mail piece is printed.

Turning to FIG. 4, as mail piece 32 continues a substantially tangential, rolling contact is maintained between roller 36 and mail piece 32 so that the image previously formed on roller 36 is transferred to one side of mail piece 32 by an offset printing process. Also, as mail piece 32 continues through print station 34, controller 70 controls printhead 38 to print a second image on the opposite side of mail piece 32. (Those skilled in the art will realize that the first and second images will be printed in opposite directions. That is, if one is printed on the mail piece from left to right, the other is printed from right to left.)

In other embodiments of the subject invention mail piece 32 may be stopped or slowed by feed roller assembly 60 as the first image is formed during successive rotations of roller 36. For example, because there is a minimum spacing between individual jets of a ink jet printhead of some embodiments of the subject invention printhead 38 can be shifted parallel to the axis of roller 36 to interleave additional rows of dots in the image formed on roller 36 during successive rotations. In other embodiments of the subject invention the phase of the operation of printhead 38 can be shifted to interleave additional dots in the circumferential direction on roller 36. In these embodiments controller 70 would monitor encoders 44 and 64 to control the velocity profiles of mail piece 32 and roller 36 so that the leading edge of mail piece 32 would arrive opposite printhead 38 with the proper velocity and phase just as formation of the image is completed.

In other embodiments of the subject invention the image formed on roller 36 can include leading and/or trailing boarders to reduce the criticality of the need to synchronize mail piece 32 and roller 36.

In still yet another embodiment of the subject invention, the first image is a high level sortation code used by a high volume mailer. Such mailers can achieve substantial savings by presorting mail and delivering the mail to appropriate Postal Service Distribution Centers or Regional Distribution Centers. For such mailers operational constraints will frequently require that such sortation be done after the mail pieces are addressed and several production streams have been merged; when sorting must be done from information printed on the mail piece when it is addressed. While the information needed could be recovered from the address or a bar coded zip code on the envelope the optical character recognition system or bar code reader needed to recover such information would be expensive and prone to error.

Accordingly, in the present embodiment of the subject invention, a printing apparatus in accordance with the subject invention can be used to print a high level sortation code designating, for example, a Postal Service Distribution Center, or Regional Distribution Center to which the mail piece is to be delivered by the mailer at the same time the same apparatus prints an address and other information on the mail piece.

Since there are less than two hundred Distribution Centers and less than ten Regional Distribution Centers, and since the high level code is printed on the relatively uncluttered back of the envelope, the code can be printed as small number of large, distinct marks which can be easily and inexpensively read. For example a code similar to an expanded version of the well know Postal Service FIM code could be used.

The above description of preferred embodiments has been provided by way of illustration only and other embodiments of the subject invention will be apparent to those skilled in the art from consideration of the above description and the attached drawings. Accordingly, limitations on the subject invention are to be found only in the claims set forth below.

What is claimed:

1. An apparatus for printing, comprising:

a) a printing station, said printing station including:

a1) a transfer roller;

a2) an ink jet printhead spaced from said transfer roller and disposed in opposing relationship with said transfer roller; and a3) a guide for guiding an item to be printed as said item to be printed passes through said station so that said item to be printed makes tangential, rolling contact with said transfer roller so that a first print image on said transfer roller is transferred to one side of said item to be printed, and so that an opposite side of said item to be printed passes proximate to said ink jet printhead;

b) a feed mechanism for feeding said item to be printed along said guide;

c) a controller for:

c1) controlling said ink jet printhead to form a reverse of said first image on said transfer roller; and c2) thereafter, controlling said ink jet printhead to print a second image on said opposite side of said item to be printed.

2. An apparatus as described in claim 1, wherein said item to be printed is a mail piece and one of said images is a postal indicia.

3. An apparatus as described in claim 2, wherein another of said images is a representation of routing or sorting information for said mail piece.

4. An apparatus as described in claim 3, wherein said information is a high level sortation code used by a mailer to presort said mail piece.

5. An apparatus as described in claim 2, wherein another of said images includes a representation of encrypted information in said indicia.

6. An apparatus as described in claim 1, wherein said item to be printed passes between said transfer roller and said ink jet printhead.

7. An apparatus as described in claim 1, wherein said second image is printed as said first image is transferred from said transfer roller.

8. An apparatus as described in claim 1, wherein said reverse of said first image is formed during a plurality of revolutions of said transfer roller.

9. A method for printing, comprising the steps of:

a) providing a printing station, said printing station including:

a1) a transfer roller; and a2) an ink jet printhead spaced from said transfer roller and disposed in opposing relationship with said transfer roller;

b) controlling said ink jet printhead to form a reverse of a first image on said transfer roller;

c) thereafter, guiding an item to be printed as said item to be printed passes through said station so that said item to be printed makes tangential, rolling contact with said transfer roller so that a first print image on said transfer roller is transferred to one side of said item to be printed, and so that an opposite side of said item to be printed passes proximate to said ink jet printhead while controlling said ink jet printhead to print a second image on said opposite side of said item to be printed.

10. A method as described in claim 9, wherein said item to be printed is a mail piece and one of said images is a postal indicia.

11. A method as described in claim 10, wherein another of said images is a representation of routing or sorting information for said mail piece.

12. A method as described in claim 9, wherein another of said images includes a representation of an encryption of information in said indicia.

13. A method as described in claim 12, wherein said information is a high level sortation code used by a miler to presort said mail piece.

14. A method as described in claim 9, wherein said item to be mailed passes between said transfer roller and said ink jet printhead.

15. A method as described in claim 9, wherein said second image is printed as said first image is transferred from said transfer roller.

16. A method as described in claim 9, wherein said reverse of said first image is formed during a plurality of revolutions of said transfer roller.

* * * * *